US006848360B2

(12) United States Patent
Naka et al.

(10) Patent No.: US 6,848,360 B2
(45) Date of Patent: Feb. 1, 2005

(54) FORM DAMPENING ROLLER DRIVING APPARATUS

(75) Inventors: Masahiro Naka, Narashino (JP); Toshiyuki Yamagata, Narashino (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 0 days.

(21) Appl. No.: 10/419,094

(22) Filed: Apr. 21, 2003

(65) Prior Publication Data

US 2003/0200881 A1 Oct. 30, 2003

(30) Foreign Application Priority Data

Apr. 30, 2002 (JP) ..... 2002-128406

(51) Int. Cl.[7] ..... B41F 7/40
(52) U.S. Cl. ..... 101/148
(58) Field of Search ..... 101/147, 148, 101/450.1, 350.1, 350.4

(56) References Cited

U.S. PATENT DOCUMENTS 4,440,081 A * 4/1984 Beisel ..... 101/148
4,991,502 A 2/1991 Akao ..... 101/148
5,158,017 A * 10/1992 MacConnell et al. ..... 101/148
5,170,706 A * 12/1992 Rodi et al. ..... 101/148
5,471,926 A * 12/1995 Junghans et al. ..... 101/148
5,562,031 A 10/1996 Garner et al. ..... 101/148
5,992,317 A 11/1999 Hummel et al. ..... 101/148
6,460,455 B1 * 10/2002 Eltner et al. ..... 101/148
6,647,875 B2 * 11/2003 Horikoshi ..... 101/216

FOREIGN PATENT DOCUMENTS

| | | |
|---|---|---|
| DE | 29 32 105 | 2/1981 |
| JP | 3-67630 | 10/1991 |
| JP | 11-198338 | 7/1999 |

* cited by examiner

*Primary Examiner*—Stephen R. Funk
(74) *Attorney, Agent, or Firm*—Wenderoth, Lind & Ponack, L.L.P.

(57) ABSTRACT

A form dampening roller driving apparatus in which to obviate a hickey a slip is caused to occur between a form dampening roller and a plate cylinder in their mutual area of contact by rotationally driving the form dampening roller and the plate cylinder so they rotate having a difference in peripheral speed between them, and wherein the peripheral speed of the form dampening roller is made variable as desired to make the slip ratio between it and the plate cylinder in their mutual area of contact variable as desired. To this end, the form dampening roller is geared to a vibrator roller, and independent of a main motor for rotationally driving the plate cylinder there is provided a further motor for rotationally driving the form dampening roller independently of the plate cylinder at a rate of rotation that is made arbitrarily variable.

12 Claims, 5 Drawing Sheets

FORM DAMPENING ROLLER DRIVING APPARATUS

BACKGROUND OF THE INVENTION

1. Field of the Invention

The present invention relates to a form dampening roller driving apparatus that is applied to a form dampening device in an offset printing press.

2. Description of the Prior Art

FIG. 3 shows a conventional roller arrangement for the offset printing press having a plate cylinder 1 rotationally driven by a main motor (not shown). A dampening device 2 is provided for supplying the peripheral surface of the plate cylinder 1 with water, thereby dampening a form (offset) plate wrapped around it. The dampening device 2 includes a water fountain roller 4 that is rotated while being in part dipped in a water tank 3, a metering roller (chrome roller) 5 that is rotated in contact with the water fountain roller 4 so that the mutually contacting surfaces of the rollers 4 and 5 move in a same direction, a form dampening roller 6 that is positioned between the metering roller 5 and the plate cylinder 1 for supplying water adhered on the metering roller 5 onto the surface of the plate cylinder 1, and a vibrator roller 7 that is rotated in contact with the form dampening roller 6 so that the mutually contacting surfaces of the rollers 6 and 7 move in a same direction. Besides, the peripheral surface of the plate cylinder 1, namely the form plate carried thereon, is supplied with ink by an inking device 8 that comprises a plurality of (two as shown) inking rollers 9, 9 each in contact with the plate cylinder 1, an ink fountain roller 10, a pickup roller 11, and a distributing roller 12 juxtaposed with the ink fountain roller 10 via the pickup roller 11, and further a first group of rollers 8*a* for supplying ink on the distributing roller 12 onto one of the inking rollers 9 via the vibrator roller 7 in the form dampening device 2 and a second group of rollers 8*b* for supplying ink on the distributing roller 12 onto the other inking roller 9 via another vibrator roller 13, the inking rollers 9 applying ink so supplied to the plate cylinder 1.

The water fountain roller 4 and the metering roller 5 are geared to each other and rotationally driven by a motor that is independent of the main motor which rotates the plate cylinder 1. Also, the form damping roller 6 is held in pressure contact with the vibrator roller 7 and under the force of friction then applied thereto is designed to be rotated at a peripheral speed that is identical to that at which the vibrator roller 7 is rotated.

Driven to rotate by the main motor provided at the press machine body, the plate cylinder 1 and the vibrator roller 7 are rotated at an identical peripheral speed, and so is the form damping roller 6. Hence, the plate cylinder 1 and the form dampening roller 6 are allowed to rotate without slipping in their region of mutual contact $S_1$.

Here, making a difference in peripheral speed between the metering roller 5 and the form dampening roller 6 causes a slip to occur between these rollers in their mutual area of contact $S_2$, and it is possible to control the rate of water supply onto the form dampening roller 6 as a function of the degree of this slip. Accordingly, the arrangement is designed to change the rate of water supply by changing the rate of rotation of a motor 14 to change the peripheral speed of the metering roller 5 and in turn to change the degree of such slip.

FIG. 4 shows a second conventional dampening roller arrangement in the offset printing press, of the type known from JP H03-67630 B, in which the plate cylinder 1 and the form dampening roller 6 are designed to be rotated at different peripheral speeds while slipping at their mutual area of contact $S_3$.

Here, the form dampening roller 6 is driven coupled to a unit drive means for rotationally driving the plate cylinder 1 or any other roller. The water fountain roller 4 in part dipped in the water tank 3 and the form dampening roller 6 are rotated at mutually different peripheral speeds while slipping at their mutual area of contact $S_4$. In this known dampening roller arrangement, too, it is designed that the water fountain roller 4 and the metering roller 5 are geared to each other and the metering roller 5 is rotationally driven by the motor 14.

FIG. 5 shows a third conventional dampening roller arrangement in the offset printing press, of the type known from JP H11-198338 A. Here again, water in the water tank 3 is supplied onto the plate cylinder 1 via the water fountain roller 4, the metering roller 5 and the form dampening roller 6. In this arrangement, however, the form dampening roller 6 is coupled to the plate cylinder 1 via a coupling device 16 having a speed selector 15 which permits a choice to be made to adopt either the slip free drive path in which the form dampening roller 6 and the plate cylinder 1 are rotated at an identical peripheral speed or the slip drive path in which the form dampening roller 6 is rotated at a peripheral speed slower than that of the plate cylinder 1, thereby slipping relative to the plate cylinder 1.

In the first mentioned type of prior arrangement in which the form dampening roller 6 and the plate cylinder 1 are rotated at an identical peripheral speed without slipping, the absence of wiping actions by slipping in the mutual area of contact $S_1$ between the plate cylinder 1 and the form dampening roller 6 tend to cause paper powder, dust, dried ink membrane or the like to adhere on the plate cylinder 1, thereby giving rise to a "hickey" being imperfections in printing areas and spots in nonprinting areas in a printed sheet of paper.

In the second mentioned type of prior arrangement in which the form dampening roller 6 is rotated by the unit drive means at a peripheral speed differing from that of the plate cylinder 1, slipping in the mutual area of contact $S_3$ enables obviating the hickey. In this prior arrangement, however, continuous slipping contact between the form damping roller 6 and the plate cylinder 1 with the slip ratio held high results in the form dampening roller 6 rubbing the plate cylinder 1, and hence tends to shorten the service life of the form plate.

The third mentioned type of prior arrangement permits the slip ratio in the mutual area of contact between the plate cylinder and the form dampening cylinder 6 to be switched between two stages. The slip ratio in each stage is held constant, however. The problem is thus encountered with this prior arrangement that it does not tend itself to optimizing the slip ratio for each of a variety of different jobs.

SUMMARY OF THE INVENTION

Made to solve the problems mentioned above, the present invention is aimed to provide a form dampening roller driving apparatus whereby the slip ratio between the plate cylinder and the form dampening roller can be established, as desired for each of different jobs, at an optimum value that is capable of obviating the hickey, and the slip ratio can be set or reset at zero in a normal operation of the printing press to lengthen the service life of a form plate.

In order to achieve the object mentioned above, there is provided in accordance with the present invention in one form of implementation thereof a form damping roller driving apparatus in which to obviate a hickey a slip is caused to occur between a form dampening roller and a plate cylinder in their mutual area of contact by rotationally driving the form dampening roller and the plate cylinder so they rotate having a difference in peripheral speed between them, which device is associated with a main motor for rotationally driving the plate cylinder and comprises: a vibrator roller geared to the form dampening roller; and a further motor provided independent of the main motor for rotationally driving the vibrator roller independently of the plate cylinder at a speed of rotation that is made arbitrarily variable.

The apparatus may further comprise a rotation speed control means whereby the speed of rotation of the further motor is made variable so as to set the difference in peripheral speed between the plate cylinder and the form dampening roller to vary continuously, discontinuously or in stages. Further, the rotation speed control means may be adapted to store a difference in peripheral speed between the plate cylinder and the form dampening roller that provides a slip ratio between them which is optimum for eliminating the hickey for each of various jobs, the rotation speed control means being also adapted to restore and establish such differences in peripheral speed for the jobs, respectively.

With the apparatus so constructed, as mentioned above, the peripheral speed of the form dampening roller can be varied as desired relative to that of the plate cylinder, which enables the slip ratio between the plate cylinder and the form dampening roller at their mutual area of contact to be varied as desired. Thus, the slip ratio can be set to a value that is optimum for eliminating the hickey for each of various jobs. Further, a normal operation of the printing press can be carried out simply upon setting or resetting the slip ratio at zero to prevent aberrant wear at that mutual area of contact.

Also, the apparatus may further include a means for making the form dampening roller into, and out of, contact with the plate cylinder, selectively. This permits tuning on and off the water supply onto the plate cylinder and adjusting the contact pressure of the form dampening roller against the plate cylinder.

BRIEF DESCRIPTION OF THE DRAWINGS

These and other objects, features and advantages of the present invention as well as other manners of its implementation will become more readily apparent, and the invention itself will also be better understood, from the following detailed description when taken with reference to the drawings attached hereto showing certain illustrative forms of implementation of the present invention. In the drawings.

DETAILED DESCRIPTION

Figure 1:
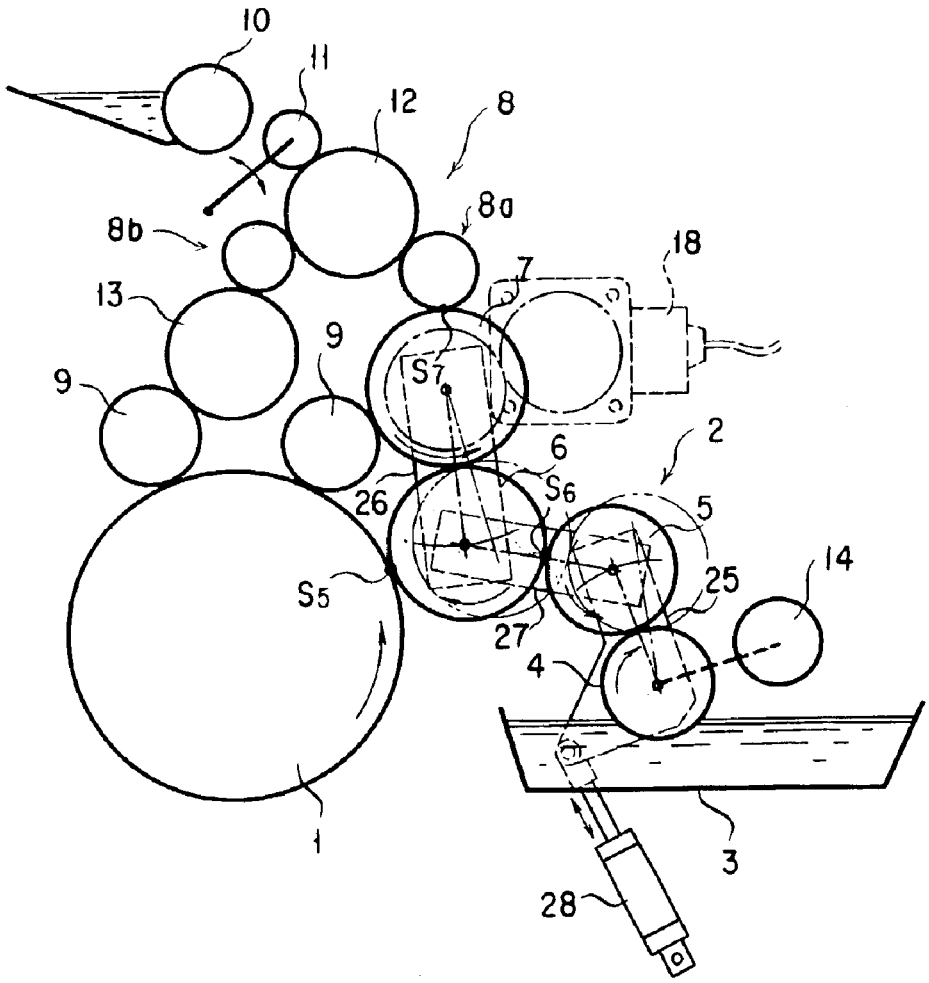
FIG. 1 is an explanatory view illustrating the schematic makeup of an apparatus as one form of implementation of the present invention.
Figure 2:
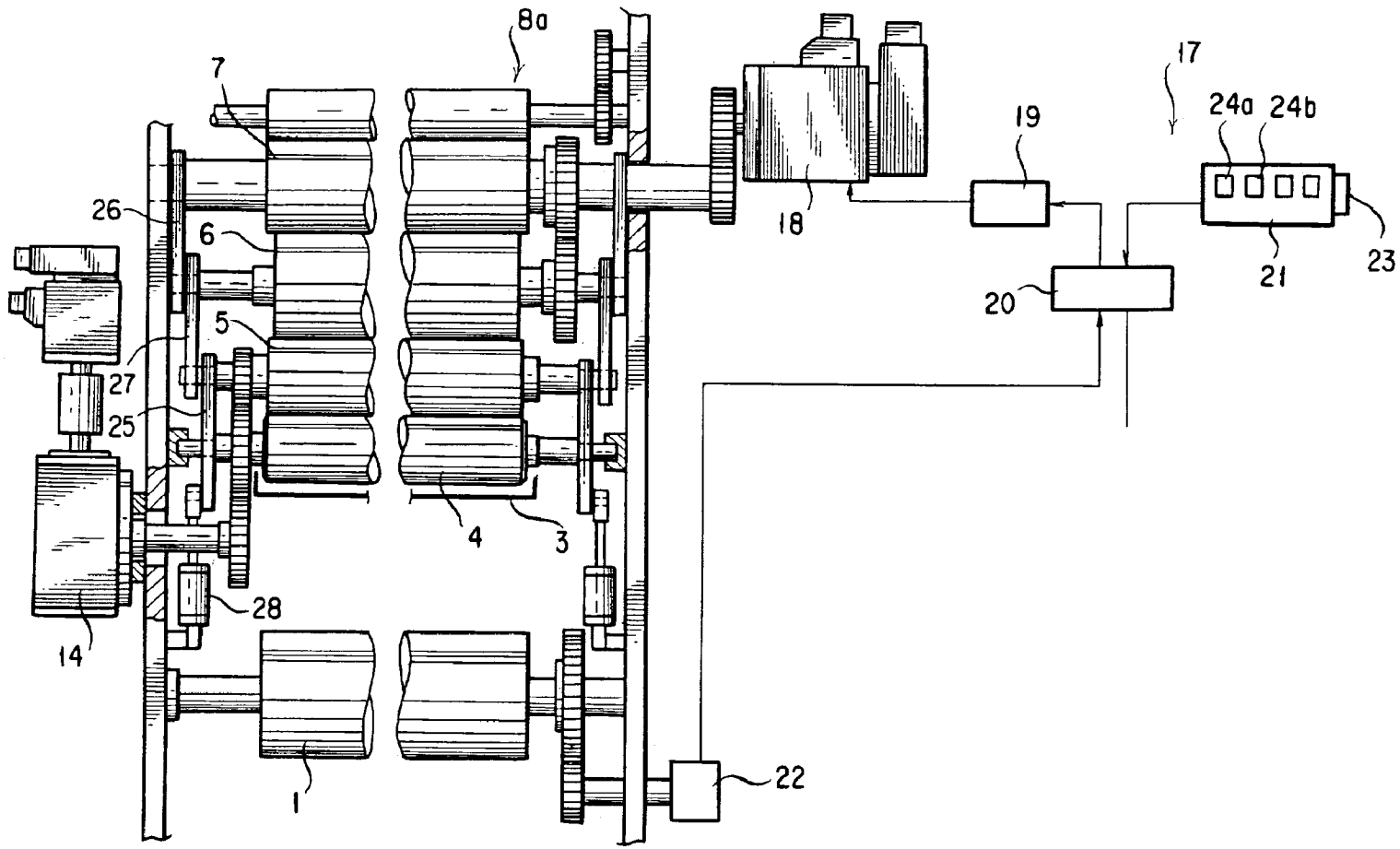
FIG. 2 is a schematic view illustrating power transmission to various rollers in the apparatus shown in FIG. 1.
Figure 3:
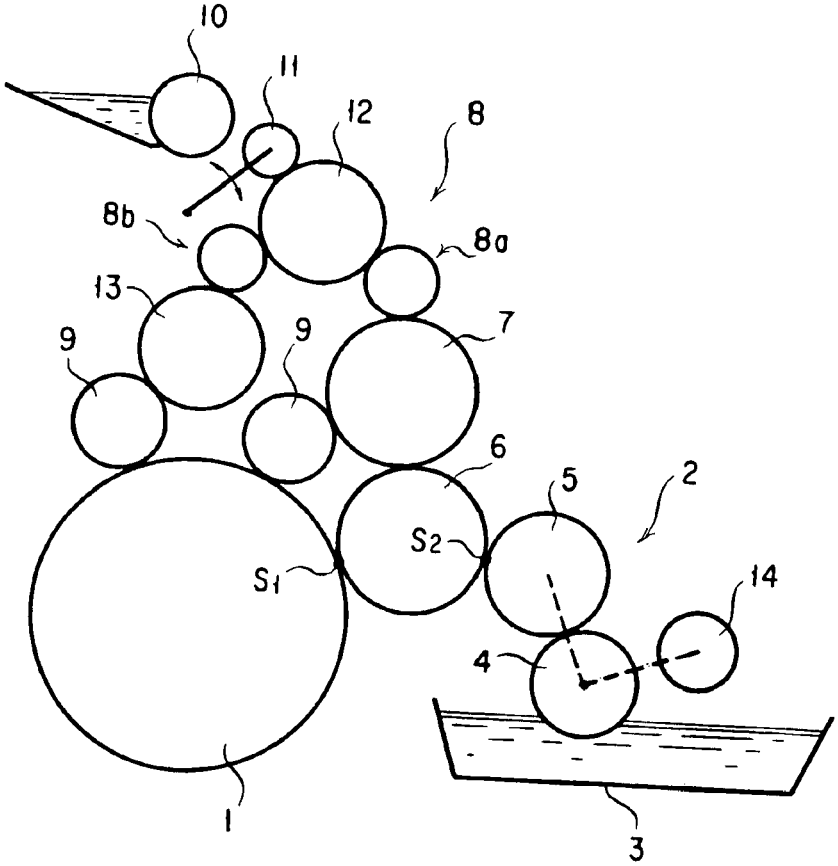
FIG. 3 PRIOR ART
FIG. 3 is an explanatory view illustrating a first prior art device.
Figure 4:
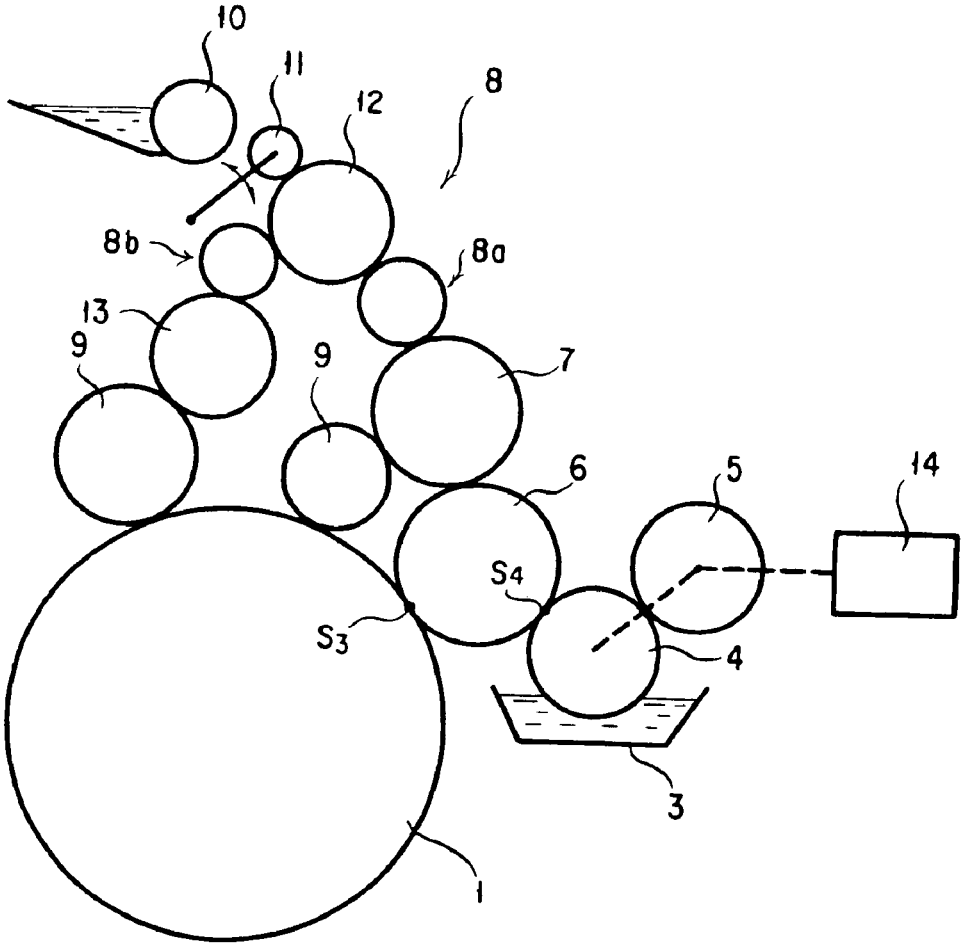
FIG. 4 PRIOR ART
FIG. 4 is an explanatory view illustrating a second prior art device.
Figure 5:
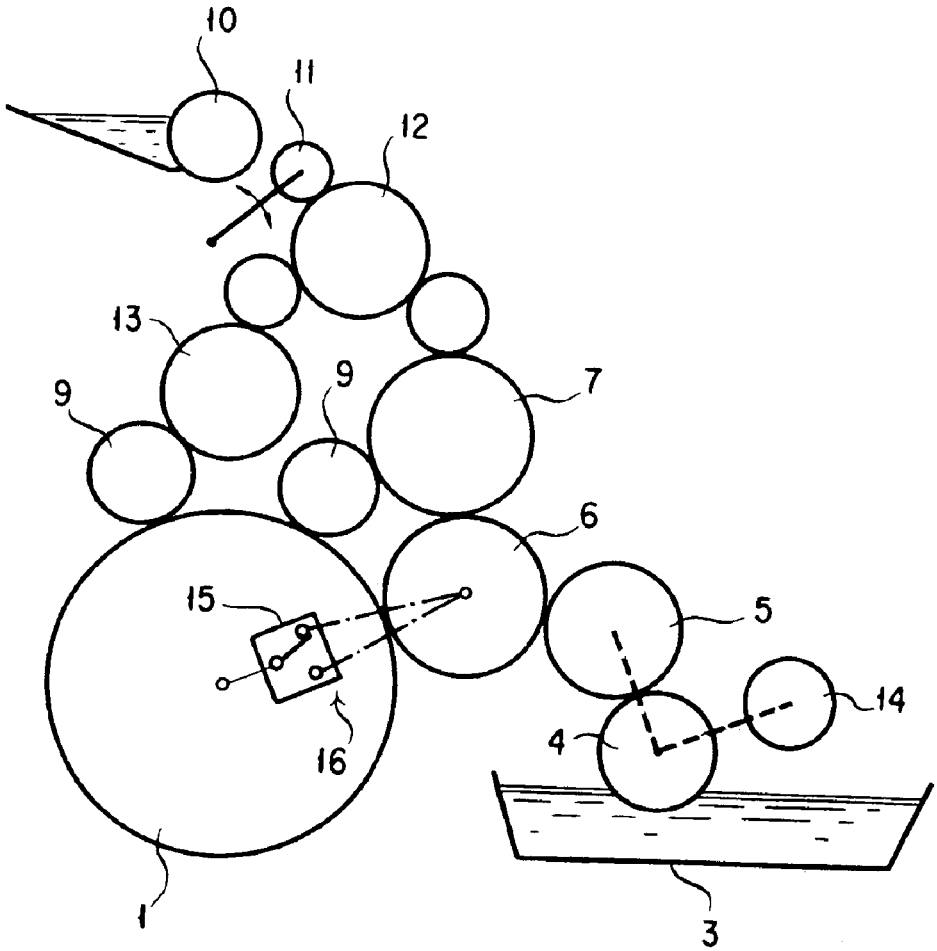
FIG. 5 PRIOR ART
FIG. 5 is an explanatory view illustrating a third prior art device.

An explanation is hereafter given in respect of a certain form of implementation of the present invention with reference to FIGS. 1 and 2. It should be noted that the same reference characters as used in the preceding description of the prior arrangements as shown in FIGS. 3 to 5 are used to designate the same components or elements, of which repeated statements are therefore omitted here.

Referring first to FIG. 1, the water-fountain roller 4 is rotationally driven at a prescribed speed of rotation by the motor 14. The metering roller 5 in contact with the water fountain roller 4 is geared to the water fountain roller 4, and is designed to be rotated at a peripheral speed differing from that of the water fountain roller 4 and thus slipping relative to the water fountain roller 4. Here, the two rollers 4 and 5 are driven by the motor 14 to rotate at their respective peripheral speeds each held at a constant ratio to a peripheral speed of the plate cylinder 1.

The form dampening roller 6 is geared to the vibrator roller 7 in contact therewith so that they may rotate at an identical peripheral speed and their respective areas of mutual contact then move in a same direction. The vibrator roller 7 is rotationally driven by a sectional motor 18 so that its speed of rotation may be controlled as desired in a prescribed range by a rotation control unit 17 shown in FIG. 2.

Referring to FIG. 2, the rotation control unit 17 comprises a motor driver 19 for furnishing the sectional motor 18 with drive signals, a controller 20 for furnishing the motor driver 19 with rotation speed signals, a rotation speed setter 21 for establishing the rotation speed signals to be furnished from the controller 20, and an encoder 22 for feeding the speed of rotation of the plate cylinder 1 back to the controller 20.

The rotation speed setter 21 is here adapted to establish the difference in peripheral speed between the plate cylinder 1 and the form dampening roller 6, namely the slip ratio at a region of their mutual contact $S_5$ (FIG. 1), continuously by means of a dial 23 and in stages or discontinuously by means of a plurality of button switches 24*a*, 24*b*, . . . For a normal operation, the rotation speed setter 21 establishes the difference in speed at zero, namely so that the peripheral speed of the form dampening roller 6 becomes equal to the peripheral speed of the plate cylinder 1.

So arranged as mentioned above, the water fountain roller 4 and the metering roller 5 are rotated by the motor 14 while giving rise to a slip between them. On the other hand, the form dampening roller 6 and the vibrator roller 7 are rotated by the sectional motor 18, independently of the water fountain roller 4 and the metering roller 5. Then, the speed of rotation of the form dampening roller 6 is established as desired by the rotation speed setter 21.

It should be noted at this point that the metering roller 5 is rotatably supported by an end portion of a rocking arm 25 pivotally supported by the shaft of the water fountain roller 4. And, the form dampening roller 6 is rotatably supported by an end portion of a rocking arm 26 pivotally supported by the shaft of the vibrator roller 7. The shafts of the rollers 5 and 6 are coupled by a link 27 so that the rocking arm 25 may have a rocking motion actuated by an air cylinder 28. Thus, with the air cylinder 28 extended and retracted, it is designed that the rocking arm 25 is allowed to rock, thereby bringing the form dampening roller 6 into contact with the plate cylinder 1 (as shown by solid lines) and out of contact therewith (as shown by chain lines). This permits switching water supply onto the plate cylinder 1, ON and OFF, and also adjusting the contact pressure of the form dampening roller 6 against the plate cylinder 1.

Mention is next made of how the peripheral speed of the form dampening roller 6 may be established by the rotation speed setter 21. For the normal operation of the printing machine, the peripheral speed of the form dampening roller 6 is set to be equal to the peripheral speed of the plate cylinder 1 to establish the slip ratio between them in their mutual area of contact $S_5$ at zero.

The printed matter then printed is visually observed to examine whether the state where the hickey appears on the form plate on the plate cylinder 1 has occurred. The rate of rotation of the form dampening roller 6 is varied to increase or decrease its peripheral speed relative to that of the plate cylinder 1 according to the appearance of the hickey, thereby gradually increasing the slip ratio between the two in their mutual area of contact $S_5$ until it reaches an established value where the hickey is eliminated. Then, the slip ratio between the form dampening roller 6 and the metering roller 5 in their mutual area of contact $S_6$ and the slip ratio between the vibrator roller 7 and the grouped inking rollers 8*a* in their respective areas of contact $S_7$ are varied as the slip ratio in the mutual area of contact $S_5$ is varied.

The slip ratio at which the hickey is eliminated varies job by job. Thus, the difference in peripheral speed or the slip ratio optimum for eliminating the hickey can be empirically derived for each of varying jobs, and such optimum differences in peripheral speeds may be stored in the rotation speed setter 21 and the button switches 24*a*, 24*b*, . . . may be set to restore them.

The normal printing operation is carried out with both of the sip ratio between the plate cylinder 1 and the form dampening roller 6 in their mutual area of contact $S_6$ and the slip ratio between the vibrator roller 7 and each of the grouped inking rollers 8*a* in their respective mutual area of contact $S_7$ reset at zero. This prevents aberrant wear in the areas of contact $S_5$ and $S_7$.

While the foregoing form of implementation of the invention is illustrated and described in connection with the ink train method of printing in which the plate cylinder 1 is supplied with both water and ink from the form dampening roller 6 and the vibrator roller 7 in contact with each other, it should be apparent that the present invention may likewise be implemented as for the conventional method of printing in which the form dampening roller 6 is used solely to supply water onto the plate cylinder 1.

Although the present invention has hereinbefore been set forth with respect to certain illustrative embodiments thereof, it will readily be appreciated to be obvious to those skilled in the art that many alterations thereof, omissions therefrom and additions thereto can be made without departing from the essences of scope of the present invention. Accordingly, it should be understood that the invention is not intended to be limited to the specific embodiments thereof set forth above, but to include all possible embodiments that can be made within the scope with respect to the features specifically set forth in the appended claims and to encompass all the equivalents thereof.

What is claimed is:

1. A form dampening roller driving apparatus comprising:

a plate cylinder;

a form dampening roller having a shaft and being adapted to be in contact with said plate cylinder;

a metering roller having a shaft and being adapted to be in contact with said form dampening roller;

a water fountain roller having a shaft and being adapted to be in contact with said metering roller;

an inking roller;

a first motor for rotationally driving said plate cylinder;

a vibrator roller having a shaft, being in contact with said inking roller and said form dampening roller, and being geared to said form dampening roller;

a second motor provided independent of said first motor for rotationally driving said vibrator roller independently of said plate cylinder at a speed of rotation that is arbitrarily variable;

a first rocking arm pivotally supported by said shaft of said water fountain roller; and a second rocking arm pivotally supported by said shaft of said vibrator roller, wherein said metering roller is rotatably supported by an end portion of said first rocking arm, said form dampening roller is rotatably supported by an end portion of said second rocking arm, said shaft of said metering roller and said shaft of said form dampening roller are linked so that said first rocking arm is capable of having a rocking motion, thereby bringing said form dampening roller into and out of contact with said plate cylinder, so that water supplied onto said plate cylinder is switched on and off, and contact pressure of said form dampening roller against said plate cylinder is adjusted.

2. A form dampening roller driving apparatus as set forth in claim 1, further comprising a rotation control unit operable to vary the speed of rotation of said second motor to set a difference in peripheral speed between said plate cylinder and said form dampening roller to be continuously variable.

3. A form dampening roller driving apparatus as set forth in claim 2, wherein said rotation control unit is operable to store a difference in peripheral speed between said plate cylinder and said form dampening roller that provides a slip ratio between said plate cylinder and said form dampening roller which is optimum for eliminating a hickey for each of various jobs, and said rotation control unit is also operable to restore and establish the difference in peripheral speed for each of the respective jobs.

4. A form dampening roller driving apparatus as set forth in claim 1, further comprising a rotation control unit operable to vary the speed of rotation of said second motor to set a difference in peripheral speed between said plate cylinder and said form dampening roller to be discontinuously variable or variable in stages.

5. A form dampening roller driving apparatus as set forth in claim 4, wherein said rotation control unit is operable to store a difference in peripheral speed between said plate cylinder and said form dampening roller that provides a slip ratio between said plate cylinder and said form dampening roller which is optimum for eliminating a hickey for each of various jobs, and said rotation control unit is also operable to restore and establish the difference in peripheral speed for each of the respective jobs.

6. A form dampening roller driving apparatus as set forth in claim 1, further comprising an air cylinder operable to actuate said first rocking arm so as to rock said first rocking arm by extending and retracting said air cylinder.

7. A form dampening roller driving apparatus for causing a slip to occur between a form dampening roller and a plate cylinder in a mutual area of contact to obviate a hickey, said form dampening roller driving apparatus comprising:

a form dampening roller having a shaft, and for contacting a plate cylinder;

a metering roller having a shaft and being adapted to be in contact with said form dampening roller;

a water fountain roller having a shaft and being adapted to be in contact with said metering roller;

a first motor for rotationally driving the plate cylinder;

a vibrator roller having a shaft, being in contact with said form dampening roller and geared to the form dampening roller, and for contacting an inking roller;

a second motor provided independent of said first motor for rotationally driving said vibrator roller independently of the plate cylinder at a speed of rotation that is made arbitrarily variable;

a first rocking arm pivotally supported by said shaft of said water fountain roller; and a second rocking arm pivotally supported by said shaft of said vibrator roller, wherein said metering roller is rotatable supported by an end portion of said first rocking arm, said form dampening roller is rotatable supported by an end portion of said second rocking arm, said shaft of said metering roller and said shaft of said form dampening roller are linked so that said first rocking arm is capable of having a rocking motion, thereby bringing said form dampening roller into and out of contact with the plate cylinder, so that water supplied onto the plate cylinder is switched on and off, and contact pressure of said form dampening roller against the plate cylinder is adjusted.

8. A form dampening roller driving apparatus as set forth in claim 7, further comprising a rotation control unit operable to vary the speed of rotation of said second motor to set a difference in peripheral speed between the plate cylinder and the form dampening roller to be continuously variable.

9. A form dampening roller driving apparatus as set forth in claim 8, wherein said rotation control unit is operable to store a difference in peripheral speed between the plate cylinder and the form dampening roller that provides a slip ratio between the plate cylinder and the form dampening roller which is optimum for eliminating a hickey for each of various jobs, and said rotation control unit is also operable to restore and establish the difference in peripheral speed for each of the respective jobs.

10. A form dampening roller driving apparatus as set forth in claim 7, further comprising a rotation control unit operable to vary the speed of rotation of said second motor to set a difference in peripheral speed between the plate cylinder and the form dampening roller to be discontinuously variable or variable in stages.

11. A form dampening roller driving apparatus as set forth in claim 10, wherein said rotation control unit is operable to store a difference in peripheral speed between the plate cylinder and the form dampening roller that provides a slip ratio between the plate cylinder and the form dampening roller which is optimum for eliminating a hickey for each of various jobs, and said rotation control unit is also operable to restore and establish the difference in peripheral speed for each of the respective jobs.

12. A form dampening roller driving apparatus as set forth in claim 7, further comprising an air cylinder operable to actuate said first rocking arm so as to rock said first rocking arm by extending and retracting said air cylinder.

* * * * *